United States Patent [19]

Krings

[11] 4,048,778

[45] Sept. 20, 1977

[54] SHEETING-PLATE FOR TRENCH SHEETING

[76] Inventor: Josef Krings, Hans-Bockler-Strasse 23, D 5138 Heinsberg - Oberbruch, Germany

[21] Appl. No.: 626,057

[22] Filed: Oct. 28, 1975

[30] Foreign Application Priority Data

Jan. 2, 1975 Germany ..... 7500036[U]

[51] Int. Cl.[2] ..... E04C 2/34; E21D 5/00

[52] U.S. Cl. ..... 52/615; 52/309.7; 52/309.11; 61/41 A; 428/181; 428/188; 428/313

[58] Field of Search ..... 165/168, 170, 171, 172; 52/619, 404, 578, 629, 630, 615, 309.1, 309.4, 309.6, 309.7, 309.11; 61/41, 41 A; 428/43, 178, 181, 313, 188; 219/117 HD, 117 R

[56] References Cited

U.S. PATENT DOCUMENTS

| | | | |
|---|---|---|---|
| 1,200,639 | 10/1916 | Moore et al. | 52/619 |
| 1,944,280 | 1/1934 | Snyder | 428/181 |
| 1,996,490 | 4/1935 | Romanoff | 52/618 |
| 2,101,056 | 12/1937 | Frick | 52/619 |
| 2,567,716 | 9/1951 | Kritzer | 52/220 |
| 2,962,130 | 11/1960 | Marsi | 52/563 |
| 3,192,099 | 6/1965 | Beckman et al. | 428/182 |

*Primary Examiner*—James L. Ridgill, Jr.
*Attorney, Agent, or Firm*—Diller, Brown, Ramik & Wight

[57] ABSTRACT

This disclosure relates to a sheeting-plate formed of two cover plates joined by transversely extending webs wherein the webs are formed integral with at least one of the cover plates by being folded out of the plane thereof and are secured to the other cover plate by welding. The webs are notched to receive upstanding reinforcing members, and the cavities defined by the webs may be filled with a reinforcing plastics material.

7 Claims, 2 Drawing Figures

SHEETING-PLATE FOR TRENCH SHEETING

This invention relates in general to new and useful improvements in sheeting-plate for trench sheeting.

The invention particularly relates to a hollow sheeting-plate which is formed of front and rear cover plates and of spacers connecting the cover plates with there being reinforcing members of tubular construction extending transversely to the spacers and passing generally vertically through the sheeting-plate. Sheeting-plates of this type are known and are, for each instance, described in German Auslegungsschrift No. 2,230,395. Sheeting-plates of this type require substantial support from various components and assembly is relatively costly. Further, the known sheeting-plates are fairly heavy so that they may be moved only with difficulty.

This invention relates to an improved sheeting-plate of the known type wherein it may be economically manufactured in a convenient manner without degrading the strength thereof.

In accordnce with this invention, the spacers which extend between the cover plates are formed integrally with at least one of the cover plates by folding the spacers from the cover plate in the form of protruding webs so that the cover plate has a comb-like shape in cross section. The protruding webs of the cover plate are of the same width as the inside spacing of the sheeting-plate between the cover plates and these webs are welded to the opposite cover plate along their folded edges.

When forming a sheeting-plate in accordance with this invention, the two cover plates are arranged in opposed relation and welded together, after which the tubular reinforcing elements are guided through notches in the webs and are suitably secured to the endmost webs. In this manner, one obtains a sheeting-plate which is light in weight on the whole and nevertheless is provided with relatively strong webs which may be further strengthened by filling the cavities with plastics material, such as synthetic foam, which, in turn, may be reinforced if desired.

In an advantageous embodiment of the invention, the cover plate webs are secured to the opposite cover plate by means of roller seam welding.

In a further advantageous embodiment of the invention, the webs are provided with recesses to receive and house the tubular reinforcing members which extend transversely of the webs. These webs advantageously are in the form of notches or slits.

With the above and other objects in view that will hereinafter appear, the nature of the invention will be more clearly understood by reference to the following detailed description, the appended claims and the several views illustrated in the accompanying drawings:

IN THE DRAWINGS

Figure 1:
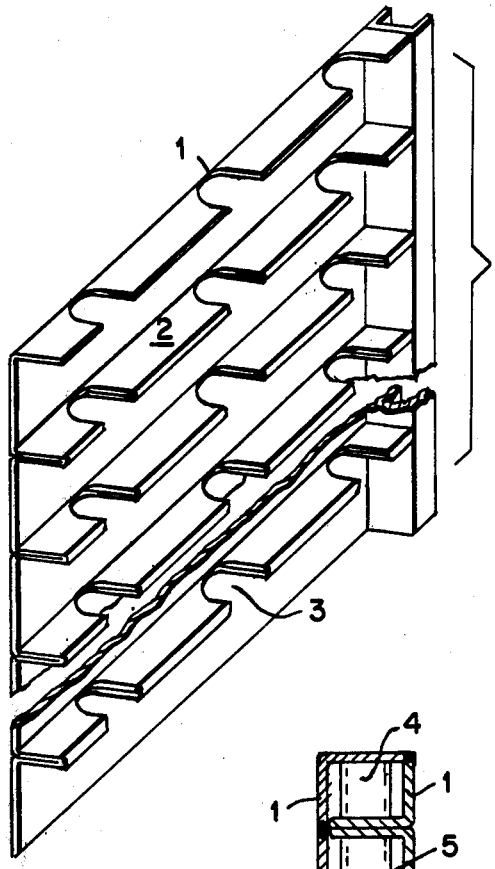
FIG. 1 is a perspective view, with intermediate portions broken away, of a portion only of the sheeting-plate, one of the cover plates being omitted.

Referring now the drawings, it will be seen that there is illustrated in FIG. 1 one half of a sheeting-plate formed in accordance with this invention, the half of the sheeting-plate including a cover plate 1 which has intermediate portions thereof reversely folded upon themselves and extending generally normal to the plate of the cover plate 1. These reversely folded and projecting portions of the cover plate 1 will hereinafter be identified as webs 2. It will be apparent from FIG. 1 that the cover plate 1 has a vertical section with the general appearance of a comb. The webs 2 are of a width in accordance with the desired spacing of the two cover plates which form the sheeting-plate, as will be described hereinafter.

The webs 2 are provided with vertically aligned recesses 3 for the purpose of receiving tubular reinforcing members in the form of pipes 4 which pass vertically through the sheeting-plate. At this time it is pointed out that while it is preferred that the recesses 3 be in the form of notches, it is also feasible for the recesses to be in the form of aligned bore holes. It is also to be understood that the tubular members 4, which are shown in FIG. 2, may be positioned with respect to the cover plate 1 and welded to the webs 2 thereof before the cover plate 1 is assembled with a further cover plate of like configuration.

Figure 2:
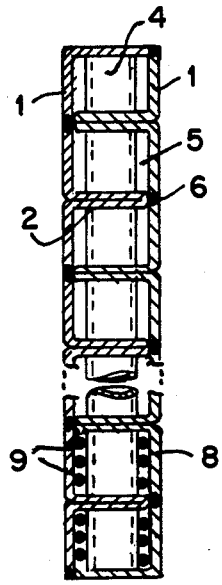
FIG. 2 is a vertical sectional view of an assembled sheeting-plate with an intermediate portion thereof being broken away and shows further the details of the sheeting-plate.

It is to be understood that when the recesses 3 are in the form of notches, as shown in FIG. 1, the notches will be of such depth that the tubular members 4 will automatically be disposed centrally in the sheeting-plate in the manner illustrated in FIG. 2.

It is to be understood that the assembly shown in FIG. 1, after the tubular members 4 have been incorporated therein, may be completed by the addition of another cover plate. The second cover plate may be in the form of a planar sheet which may be suitably welded to the webs 2. It is, however, preferred that the second cover plate be of an identical construction to the cover plate 1, but rotated 180 degrees therefrom. The cover plate 1, in such event, would be so configurated that the webs of the second cover plate would be disposed intermediate the webs of the first cover plate and the recesses 3 therein would receive the reinforcing members 4.

It will be seen from FIG. 2 that by providing each cover plate with a terminal web, there will be a web forming the upper and lower ends of the sheeting-plate. It will also be understood that each sheeting-plate may have the sides thereof defined by suitable vertical beam members, such as the channel member 7 of FIG. 1.

As is clearly shown in FIG. 2, the webs 2, together with the cover plates 1, define a plurality of cavities 5. These cavities 5 are preferably formed with a reinforcing material. The reinforcing material is preferably in the form of plastics material and more particularly foamed synthetic plastics material which may be suitably reinforced. In FIG. 2 the plastics material is generally identified by the numeral 8 and the reinforcement thereof is identified by the numeral 9. It is to be understood that the plastics material may be such suitable material as foam rubber or foamed polyurethane.

As is also clearly illustrated in FIG. 2, the two cover plates of a sheeting-plate will be preferably secured together by roller resistance seam welding of each edge of each web to the opposing cover plate as designated by the numeral 6.

It is to be understood that the spacing of the webs 2 may be uniform, as shown in FIGS. 1 and 2, or the webs 2 may be irregularly spaced in accordance with the expected stresses on the sheeting-plate.

Although only a preferred embodiment of the invention has been specifically illustrated and described herein, it is to be understood that minor variations may be made in the sheeting-plate construction without departing from the spirit and scope of the invention, as defined by the appended claims.

What is claimed as new:

1. A new article of manufacture in the form of a sheeting-plate for trench sheeting of the type comprising first and second upstanding cover plates, spacers extending between said cover plates and maintaining said cover plates in spaced generally parallel relation, and reinforcing members extending vertically between said cover plates and transversely through said spacers, said sheeting-plate being improved by at least one of said cover plates being folded out of the plane thereof to form a plurality of laterally extending webs, said webs forming said spacers with said webs being horizontally disposed, and securing means securing said webs to an inner surface of the other of said cover plates, said webs being of a width equal to the spacing between said cover plates, said webs including portions of said one cover plate reversely folded upon themselves and including a reverse fold opposing said other cover plate, said securing means being in the form of seam welding joining said folded edge to said other cover plate, and said webs have aligned recesses receiving said reinforcing members, said webs being formed on both of said cover plates and being generally arranged in alternating parallel relation.

2. A sheeting-plate according to claim 1 wherein said recesses are in the form of notches opening through edges of said webs remote from the respective cover plate.

3. A sheeting-plate according to claim 1 wherein said webs are uniformly spaced along said cover plates.

4. A sheeting-plate according to claim 1 wherein said sheeting-plate has cavities defined by said cover plates and said webs, and a plastics material filling said cavities.

5. A sheeting-plate according to claim 1 wherein said seam welding is roller seam welding.

6. A sheeting-plate according to claim 1 wherein there are means fixedly securing said reinforcing members to said webs of at least one of said cover plates.

7. A sheeting-plate according to claim 1 wherein there is welding fixedly securing said reinforcing members to said webs of at least one of said cover plates.

* * * * *